US012252165B2

(12) United States Patent
Minor et al.

(10) Patent No.: US 12,252,165 B2
(45) Date of Patent: Mar. 18, 2025

(54) RAILROAD PATH OPTIMIZATION

(71) Applicant: Advanced Rail Systems, LLC, Reisel, TX (US)

(72) Inventors: John Michael Minor, Mart, TX (US); Gustavo Vargas, Reisel, TX (US)

(73) Assignee: Advanced Rail Systems, Riesel, TX (US)

( * ) Notice: Subject to any disclaimer, the term of this patent is extended or adjusted under 35 U.S.C. 154(b) by 185 days.

(21) Appl. No.: 18/120,999

(22) Filed: Mar. 14, 2023

(65) Prior Publication Data

US 2023/0406378 A1 Dec. 21, 2023

Related U.S. Application Data

(63) Continuation-in-part of application No. 18/114,190, filed on Feb. 24, 2023.

(60) Provisional application No. 63/313,518, filed on Feb. 24, 2022.

(51) Int. Cl.
*B61L 27/16* (2022.01)
*B61L 27/04* (2006.01)
*B61L 27/70* (2022.01)

(52) U.S. Cl.
CPC ..... *B61L 27/16* (2022.01); *B61L 27/04* (2013.01); *B61L 27/70* (2022.01)

(58) Field of Classification Search
CPC ..... B61L 27/20; B61L 27/16; B61L 27/04
See application file for complete search history.

(56) References Cited

U.S. PATENT DOCUMENTS 4,361,300 A * 11/1982 Rush ..... B61L 27/12 246/5
2007/0299570 A1* 12/2007 Muinonen ..... B61L 17/02 701/19
2008/0033605 A1* 2/2008 Daum ..... B61L 27/16 701/19
2009/0230254 A1* 9/2009 Daum ..... B61L 27/20 701/19
2010/0023190 A1* 1/2010 Kumar ..... B61L 27/53 701/20
2013/0103313 A1* 4/2013 Moore ..... G01C 21/3664 701/533
2017/0113707 A1* 4/2017 Ghaly ..... B61L 23/14
2019/0359238 A1* 11/2019 Ding ..... G06F 3/0481
2022/0242470 A1* 8/2022 Simkin ..... B61L 27/16
2022/0348242 A1* 11/2022 Vujanic ..... B61L 27/60

* cited by examiner

*Primary Examiner* — Long T Tran

(57) ABSTRACT

The invention provides railroad path optimization method. The method determines whether at least one switch machine from a plurality of switch machines is occupied in the at least one route and detects at least one unavailable route if the at least one switch machine is occupied. Further, the method identifies at least one desired route and at least one available route associated with an origin point and at least one desired route and at least one available route associated with a destination point to identify at least one available route for the destination point. Based on the identified available route, the method predicts the at least one optimal route and ranks the at least one predicted optimal route to enable selection of a final optimal route for travel.

8 Claims, 13 Drawing Sheets

RAILROAD PATH OPTIMIZATION

RELATED APPLICATION AND CLAIM OF PRIORITY

This application is a Continuation in Part of and claims priority to co-pending Utility patent application Ser. No. 18/114,190 entitled RAILROAD COMPUTING SYSTEM AND DEVICE filed on Feb. 24, 2023 which claims priority to U.S. Provisional Application No. 63/313,518 entitled Software for Railyard and Advanced Railroad Machine-to-Machine Interface filed on Feb. 24, 2022, each having common inventor John Michael Minor.

TECHNICAL FIELD

The invention generally relates to railroads, and more specifically to identifying and implementing a path for train routing.

PROBLEM STATEMENT AND HISTORY

Interpretation Considerations

This section describes technical field in detail and discusses problems encountered in the technical field. Therefore, statements in the section are not to be construed as prior art.

Discussion of History of the Problem

Today, as more and different rail types are available for transport, the options for selecting routes are proliferating. However, in railyards as well as on rail lines path control decisions are made by persons specializing in this skill (typically called "railyard operators") at the railyard itself, and less frequently at a centralized control location.

These operators take into consideration rail occupancy, train and car origins, and desired train and car destinations. Often, these decisions are made using complex routing tables and on some occasions trains sit idle outside of switch yards simply waiting on routing decisions to be made. This results in logistics bottlenecks of, at times, a day or more and in the world of logistics time is money.

Accordingly, there is the need for providing the optimal route in the railroad system that overcomes these and other limitations with the prior art. The present invention provides these and other advantages.

SUMMARY

The invention provides a railroad path optimization process. Generally, a method according to the invention identifies an origin (or 'entrance') and a destination (or 'exit'), and defines rail-paths connecting the origin to the destination as potential routes, tests each route in a predefined preference order, and then priorities available with the origin and destination.

The method for finding an optimal route for a rail in a railroad track system begins when it receives a request to find at least one optimal route from a plurality of potential routes in a railroad track system, and then proceeds to identify at least one route from the plurality of potential routes meeting the identified criteria.

To achieve this result, the method queries switch machines (preferably smart switch machines) and sensors to determine if an operating switch machine or sensor is occupied (such as by a train, car, or maintenance worker for example) in a route. If a switch machine in the route is occupied, the method identifies the route as an unavailable route.

Based on such identification and historical data analysis achieved via artificial intelligence (AI) the method sequentially prioritizes at least one optimal route from the plurality of potential routes which may then be automatically implemented, or selected by a track operator. Routes may also be ranked based on a variety of factors, such as fuel consumption, speed, risks, offloading time, among other factors. The aforesaid method is, in an embodiment, performed by a railroad computing device. Of course, the present is a summary, and not a complete description of the invention which is defined in the Claims.

BRIEF DESCRIPTION OF THE DRAWINGS

Various aspects of the invention and its embodiment are better understood by referring to the following detailed description. To understand the invention, the detailed description should be read in conjunction with the drawings, in which.

DESCRIPTION OF AN EXEMPLARY PREFERRED EMBODIMENT

Interpretation Considerations

Figure 1:
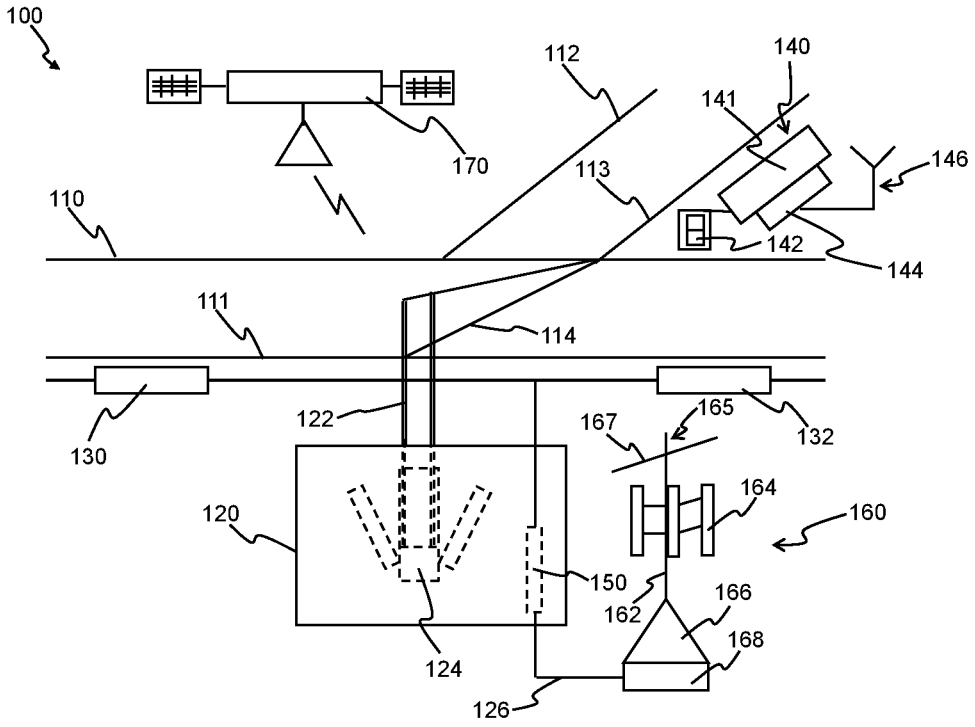
FIG. 1 illustrates an overview of a track switch schematic illustrating a deployment option for the invention.

While reading this section (Description of An Exemplary Preferred Embodiment, which describes the exemplary embodiment of the best mode of the invention, hereinafter referred to as "exemplary embodiment"), one should consider the exemplary embodiment as the best mode for practicing the invention during filing of the patent in accordance with the inventor's belief. As a person with ordinary skills in the art may recognize substantially equivalent structures or substantially equivalent acts to achieve the same results in the same manner, or in a dissimilar manner, the exemplary embodiment should not be interpreted as limiting the invention to one embodiment.

The discussion of a species (or a specific item) invokes the genus (the class of items) to which the species belongs as well as related species in this genus. Similarly, the recitation of a genus invokes the species known in the art. Furthermore, as technology develops, numerous additional alternatives to achieve an aspect of the invention may arise. Such advances are incorporated within their respective genus and should be recognized as being functionally equivalent or structurally equivalent to the aspect shown or described.

A function or an act should be interpreted as incorporating all modes of performing the function or act, unless otherwise explicitly stated. For instance, sheet drying may be performed through dry or wet heat application, or by using microwaves. Therefore, the use of the word "paper drying" invokes "dry heating" or "wet heating" and all other modes of this word and similar words such as "pressure heating".

Unless explicitly stated otherwise, conjunctive words (such as "or", "and", "including", or "comprising") should be interpreted in the inclusive and not the exclusive sense.

As will be understood by those of the ordinary skill in the art, various structures and devices are depicted in the block diagram to not obscure the invention. In the following discussion, acts with similar names are performed in similar manners, unless otherwise stated.

The foregoing discussions and definitions are provided for clarification purposes and are not limiting. Words and phrases are to be accorded their ordinary, plain meaning, unless indicated otherwise.

DESCRIPTION OF THE DRAWINGS, A PREFERRED EMBODIMENT

Introduction

The invention provides a railroad computing device having a programmable processor capable of controlling any yard switch machine on the market, or any railroad device such as a single switch, wheel or track sensor, crossover, gates, bridges, crossings, derails and Blue Flag systems, for example. The processor can be programmed to execute any task compatible with its input banks or output banks, communication interfaces, wireless communication systems, and also consistent with processing capabilities as described below.

Operation modes provide generic inputs and outputs while the input and output functions are controllable and definable by a program installed in memory or operating remotely in communication with the reward computing device. A variety of pretested configurations for common applications are provided by custom programming available from Advanced Rail Systems® of Waco, TX.

The railroad computing device provides a method for finding an optimal route for a rail in a railroad track system. The method comprises receiving a request to find at least one optimal route from a plurality of routes in the railroad track system and identifying at least one route from the plurality of routes to travel in the railroad track system. Further, the method determines whether at least one switch machine from a plurality of switch machines is occupied in the at least one route and detects at least one unavailable route from the plurality of routes upon determining that the at least one switch machine from the plurality of switch machines is occupied. The method identifies at least one desired route and at least one available route associated with an origin point and at least one desired route and at least one available route associated with a destination point to further identify at least one available route from the plurality of routes for the destination point. Based on such identification, the method predicts the at least one optimal route from the plurality of routes. In case, if multiple optimal routes are identified, then the method ranks the at least one predicted optimal route from the plurality of routes to enable selection of a final optimal route for travel and displays the same on a screen.

DESCRIPTION OF THE FIGURES

FIG. 1 illustrates an overview of a track switch schematic 100 illustrating a deployment option for the invention. The first track switch schematic includes a main route stock rail track comprising a first rail 110 and a second rail 111, a diverging route stock rail track comprising a third rail 112 and a fourth rail 113, a rail tongue 114, and a plurality of railroad related devices such as a switch machine 120, and track sensors 130, 132 and remote track sensor system 140.

One exemplary switch machine is the ML18 switch machine 120 available from Advanced Rail Systems® of Waco, Texas, which is coupled to the tongue 114 the rods 122. The switch machine 120 includes a switch-point mover 124, and a railroad computing device 150 which is described in more detail below. The switch machine 120 may be coupled to a power and communications tower 160 via wire lines 126. The power and communications tower 160 generally comprises a base station 168, a when power source such as a Savonius wind generator 166 or a solar panel 167 shown elevated by pole 162. the poll 162 also supports cellular communication antenna 164 as well as a near field communications antenna 165. Although not illustrated, a satellite communications antenna may be provided to facilitate communications with a satellite 170, such as a Starlink® satellite.

Also shown in FIG. 1 is a remote sensor system 140 which comprises an adjustable sensor 141, and a communications and power module 144. The communications and power module 144 being shown coupled to a solar panel 142 and a wireless antenna 146. although a solar panel is shown in FIG. 1. It will be readily understood to those skilled in the relevant art that the solar panel could be interchanged with a another remote power device such as a windmill generator, and that the wireless antenna 146 is chosen to be compatible with a chosen wireless communication system including near field communications comprising Wi-Fi and Bluetooth, for example or remote communications comprising cellular or satellite communications, for example.

A first layer of weather resiliency is provided to the railroad computing device 150 by the switch machine 120, while the railroad computing device 150 itself provides an additional layer of protection from elements such as fog, water, and corrosive chemicals, for example. Preferably, components and parts of the railroad computing device when 50 are chosen to provide operational resiliency in at least temperatures from −40 degrees Celsius to 85 degrees Celsius.

Figure 2:
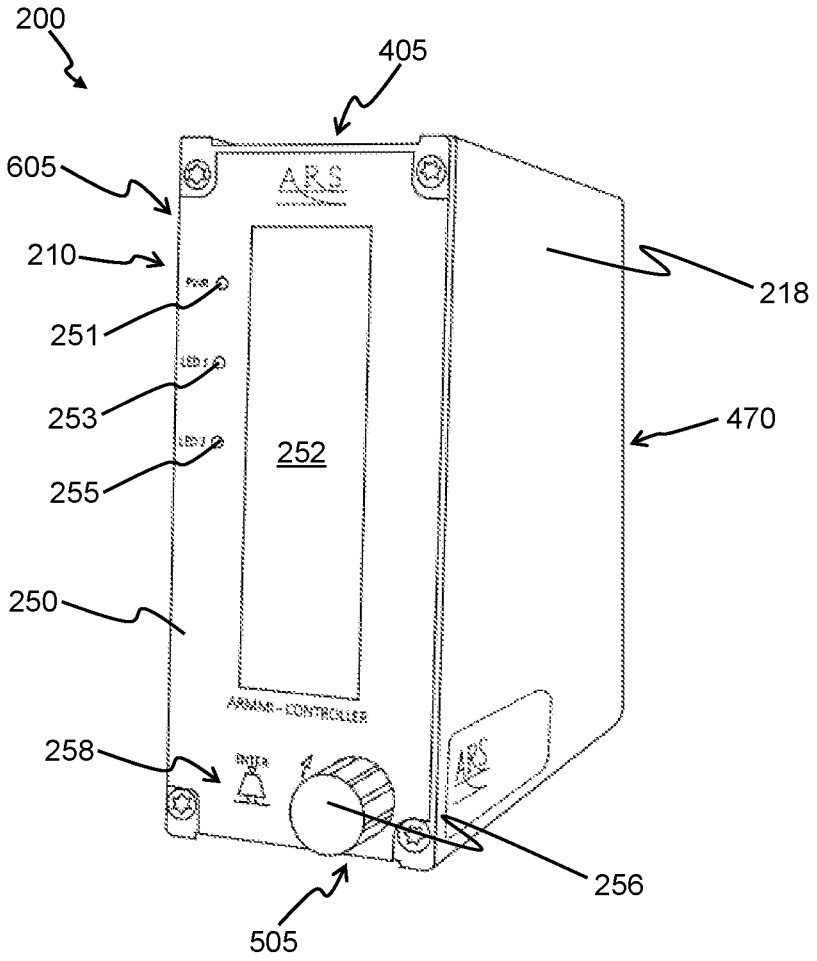
FIG. 2 illustrates a front-corner view of a first embodiment of a railroad computing device.

FIG. 2 illustrates a front-corner view of a first embodiment of a railroad computing device 200. The railroad computing device 200 includes an aluminum housing 210, where the aluminum housing 210 comprises a housing front 250, a housing top 405, a housing bottom 505, a housing back 470 and exposed side 605, and an unexposed side 218. The aluminum housing 210 also has an interior that is discussed later. The housing front 250 has A screen 252, and a plurality of LED's, including a first LED 251 illustrating a power-on/off condition, a second LED 253, and third LED 255 (the second and third LEDs are auxiliary and program-definable LEDs). The screen 252 is preferably an Organic Light Emitting Diode (OLED), and is adapted to display a plurality of alphanumeric characters, the screen 252 is coupled to a user-interface board (discussed below).

The screen 252 is particularly useful for displaying information including: firmware and project information and versions, configuration parameters and communication addresses, active inputs and outputs for diagnostics, battery voltage, temperature, real time clock information, communications statuses, an internal counter, flag, alarm, or other performance indicator defined by an active project or software, as well as graphics that may aid a user in the field in diagnosing and troubleshooting a problem, or for interacting with any input or output related to the railroad computing device. Similarly, a Z1 (Zone 1) controller may show a number of wills in each zone, speed of movement, occupancy flags, and the like.

A user-interactive input device 256, shown here as a push-button and rotatable knob, is adapted to allow a user to scroll through an alphanumeric data displayed on the screen 252. As discussed below, the user-interactive input device 256 is coupled to a user-interface board. To facilitate user-interaction, also provided on the housing front 250 are user instructions 258. The input device 256 allows a user to navigate between panels and access information. And, when the input device 256 is pressed the display is activated and powers on. This allows standard configuration parameters to be adjusted in the field through the input device 256 and screen 252 rather than forcing the use of a computer interface device or web interface device in the field or at a remote location. In one embodiment, to exit the configuration menu, the user scrolls to the last option in the menu by rotating the input device 256, and selects return by pressing the input device 256 to resume normal operation. typically, this "return" option in the configuration menu manages this operation automatically and restarts the processor when necessary. While some configurations take place immediately after adjusting them, others require that the onboard processor be restarted to implement changes to the configurations.

Figure 3:
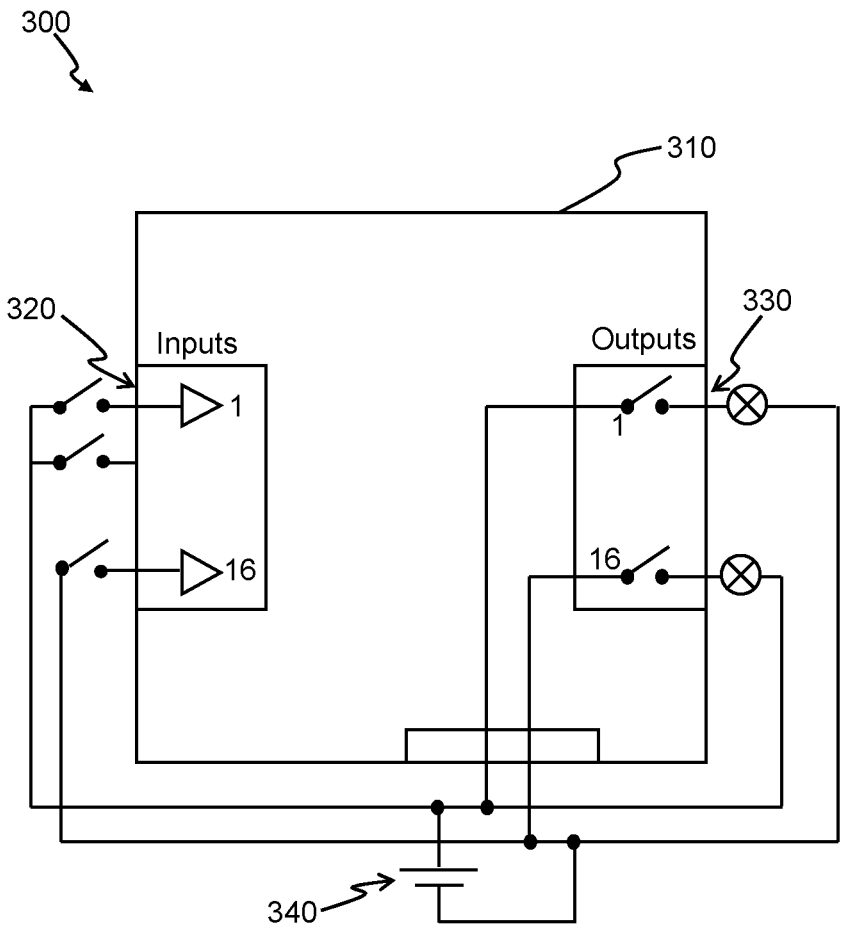
FIG. 3 illustrates a schematic of a power configuration for an embodiment of the invention.

FIG. 3 illustrates a schematic 300 of a power configuration for an embodiment of the invention. The schematic shows a railroad computing device 310 having a bank of inputs 320 (shown here are inputs 1-16) and a bank of outputs 330 (shown here are outputs 116). A battery 340 is shown providing positive power channels to a first group of inputs and outputs, for example input channels 1 through 14, and output channels 1 through 14. The battery 340 also provides negative power channels to a second group of inputs and outputs, for example input channels 15 and 16 as well as output channels 15 and 16.

Preferably, positive inputs except voltages ranging between 9 volts DC up to 26 volts DC to be considered active. Negative inputs are active when connected to 0 volts DC, which is typically the batteries negative voltage. Positive outputs, when active can drive up to three amps with the same voltage from the external power supply's voltage. Preferably, the first eight positive outputs include circuitry that allow the onboard processor to confirm the presence of a load when an output is active. The negative outputs can sync as much as two amps each. Preferably, all outputs include load monitoring capabilities and overload protection that will shunt the output down in the event of an overload or short circuit. When this happens, in one embodiment, the program running on the processor or remotely is informed of this failure for the first eight outputs. Output can resume normal operation automatically after the short circuit is solved.

Figure 4:
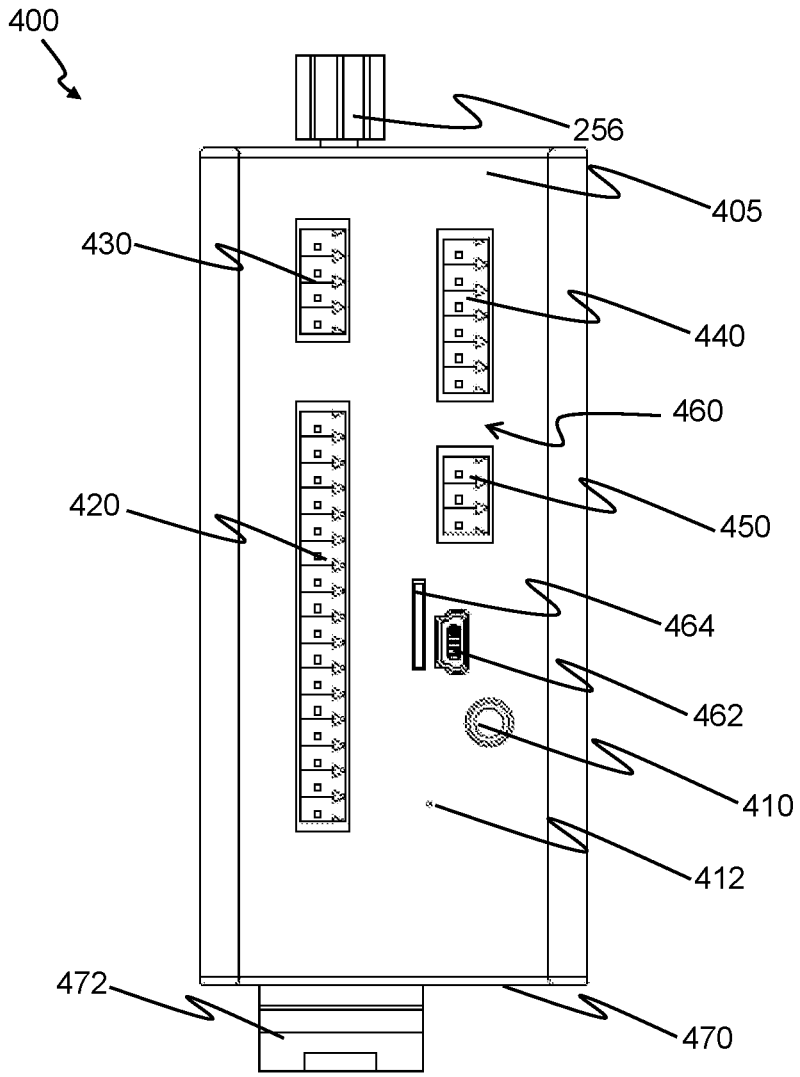
FIG. 4 shows a top-down view of the first embodiment of the railroad computing device.

FIG. 4 shows a top-down view of the first embodiment of the railroad computing device, showing the housing top 405. From FIG. 4 it can be seen that the housing top 405 comprises a bank of output connectors 420 that preferably has 16 outputs, a bank of power connectors 430, a bank of communication channel connectors 440, an RS-485 connector bank 450, memory slots including a slot for a Micro SD-Card 464, a slot for a mini-USB 462, a plug for coupling to a wireless communications wire 460, a microphone plug 410, and a hole 412 that leads to an internal board-mounted mic. The connection of the opponents shown in FIG. 4 to their respective buses and boards internal to the housing are readily apparent to those of skill in the arts upon reading this disclosure. The bank of output connectors 420 includes connectors comprising at least a first output connector adapted to send a control signal to a first railroad device. Also illustrated in FIG. 4 is the DIN-rail coupling 472 coupled to the housing back 470. The communication channel connectors 440 include an RS-232 connector.

Figure 5:
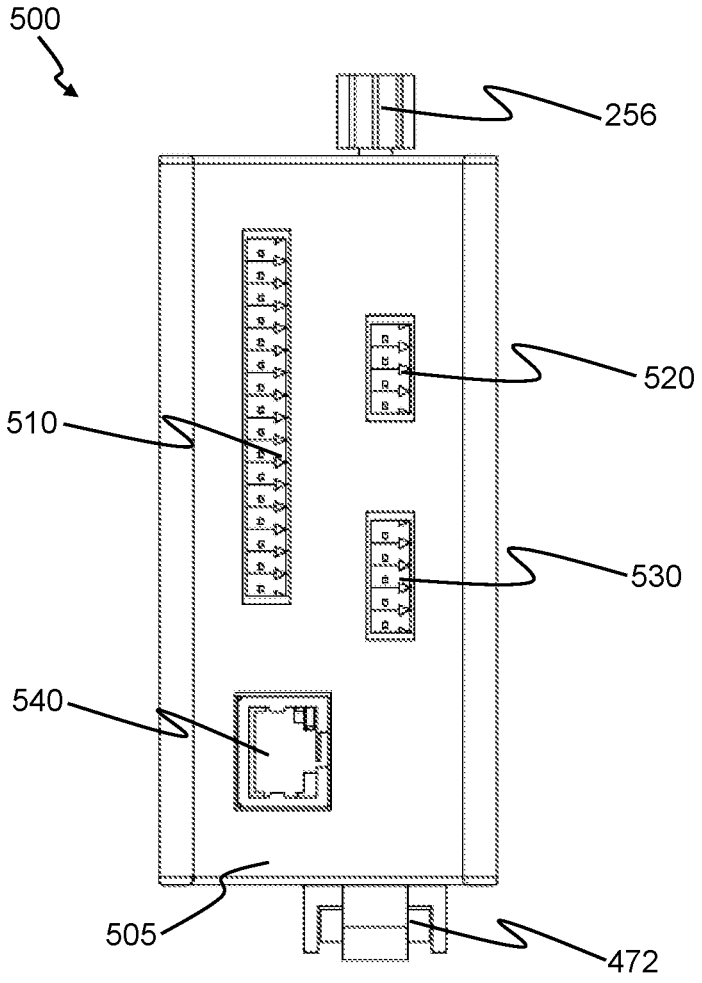
FIG. 5 shows a bottom-up view of the first embodiment of the railroad computing device.

FIG. 5 shows a bottom-up view 500 of the first embodiment of the railroad computing device showing the housing bottom 505 in more detail. In FIG. 5 is shown a bank of input connectors 510, preferably having 16 input connectors, a bank of communication inputs 520 including a speaker connector, a microphone connector, as well as a PTT an reference connector for a CANbus. Also provided is a CANbus bank of connectors 530 including connectors related to: CAN-L, CAN-H, a reference and shunts. Lastly, the housing bottom includes a wire line data communication receptacle 540 which is preferably an Ethernet connector. The Ethernet connector is preferably an Ethernet 10/100 IPv4 communication port.

Connectors on top and bottom of the housing facilitate installation when using DIN-rail installation. Most connectors are intentionally designed in different sizes to ensure they are not connected at the wrong position when replacing processors in the field.

Figure 6:
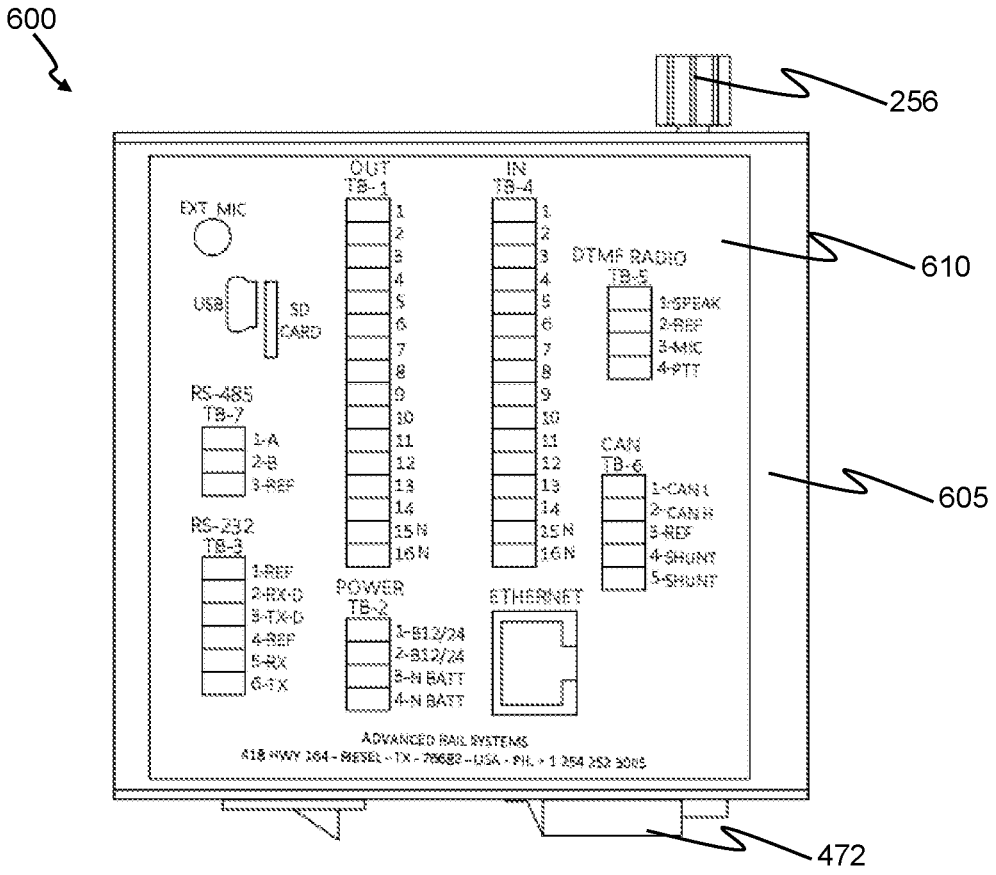
FIG. 6 provides an exposed-side view of the first embodiment of the railroad computing device.

FIG. 6 provides an exposed-side view 600 of the first embodiment of the railroad computing device. From the exposed side view 600 one can see that on the exposed side 605 is provided a computing device layout chart 610. Further, from this view, one can see that the DIN-rail coupling 472 is adapted to snap into a DIN-rail such that a channel is provided through which a communications bus and slash or a power bus can be run and allow multiple railroad computing devices to be couple slash daisy-chained together.

Connections and Ports in More Detail

The input connections accept between 9 volts DC and 26 volts DC. Preferably, 7 of 16 inputs and four of 16 outputs can be configured to use OSD signals. Two out of 16 outputs and two out of 16 inputs are preferably negative types to facilitate interconnection with vital railroad track circuits (as this term is readily understood by those in the railroad arts. All inputs and outputs are surge protected to resist high voltages, and are implemented as connector pins known to those of skill in the railroad arts, such as those available from Wago®.

Communication connections include RS-232 serial ports (spread spectrum, GPRS, and GSM compatible), and RS-485C cereal connectors. CANbus communication ports enable remote operation. Additionally, an input is provided for remote control using hand held the HF radios with Dual tone Multi-Frequency (DTMF) and voice messages. In one embodiment 32 messages of 20 seconds each are provided. Available communication protocols include ASP (Advanced Rail Systems Secure Protocol®), MQTT, Modbus TCP and RTU, as well as genesis.

In one embodiment, the railroad computing device 210 includes four serial ports: two CAN buses, an RS-232, and an RS-485C. The RS-232 can operate with different protocols as defined by the program or project that is running. Because the R-232 can communicate with any source of RS-232 signals, It may handle communications via USB to RS-232 adapters, data radios, GPRS radios, and other RS232 ports for example for the railroad computing device 210 RS232 port communicates with seven and eight bits, in one, odd and even parity, one stop bit, and in one embodiment operates from 300 bits per second up to 250 kilobits per second. This allows the RS-232 to enable the railroad computing device 210 to be Daisy chained as described below in FIG. 6.

The available RS-485C port can operate using following parameters: 7 and 8 bits, no parity, 1 stop bit, and preferably operates from 300 bps up to 130 kbps. Preferably, the network topology uses a bus with short leads, and preferably the bus is a twisted pair with 120 ohms of characteristic impedance. The bus terminators increase the stability of the system however are optional when this system runs at a low baud rate. The railroad computing platform 210 applies a bias and high termination to the bus line. This enables multiple devices to be installed between terminators. In the event the bus cable includes a shield (or is itself shielded cable) it can be connected to the reference signal provided at the RS-485C connector. in one embodiment the RS-485C connector communicate with one or more wheel counters and/or track sensors. In one embodiment as many as 21 will counters or track sensors are connected to a single railroad computing device and the logic that creates protection zones is handled in software. This enables sharing of each zones counting with other communication interfaces both local to the railroad devices as well as for remote monitoring.

The two CAN interfaces interconnect multiple railroad computing devices in a closed network. In this configuration the railroad computing devices share internal flags, registers, and signals to allow for the interaction of the railroad computing devices between projects to control each other. A crossover is a simple use case where two railroad computing devices are connected to allow two railroad switch machines to be controlled in synchronicity from a single point. Here, the topology is similar with that used by RS-485, with three differences: terminators must be used, shield connections must be used, and stubs should be as short as possible.

Each railroad computing device includes an internal Terminator that must be active by the installation of a jump at the CA N bus connector. Accordingly, a user can install jumps on units at the ends of a bus cable, or use an external terminator, such as a 120-ohm terminator. When using terminators two terminators must be used, one at each end of the bus cable. In a preferred embodiment, a properly terminated bus we'll have 60 ohms of resistance between its wires.

Daisy chaining railroad computing devices is protocol dependent. Specifically, when a data source, such as a data radio, is coupled to a railroad computing device's RS-232 input, any other railroad device that is protocol compatible, may be connected to the RS-232 output to accomplish a Daisy chain output. To achieve a Daisy chain each device must have a unique network identification. With a Daisy chain setup a single data radio or other data source may communicate with multiple railroad computing devices. This reduces hardware costs and may reduce signal latencies while increasing communication reliability. In this configuration, Genisys functions include: 0xF1—requested data response, 0xF2—acknowledged acknowledge, 0xFA—acknowledge received data, 0xFB—Request modified index, 0xFC—write index, 0xFD—request full index, and Modbus RTU functions include: 0x03—read multiple holding registers, and 0x04—read multiple input registers.

The Ethernet port 540 parameters may be adjusted by software or through a web interface. For security reasons the Ethernet port does not work with DHCP or any other automatic configuration protocol. Accordingly, a user must manually set the parameters for the port to properly work, including unit IP, MAC (optional), sub-net mask, Gateway IP, DNS IP, and optional SNTP IP. A user may also set other parameters, including: enable internal HTTP server for remote configuration, set TCP/UDP port for modbus/TCP protocol, set UDP port for Genisys protocol, and set UDP port and keys for ASP protocol. However, it is preferred that only one protocol is selected for each application. HTTP protocol is active at the same time via port standard 80 thus allowing users to connect to the railroad computing device using a standard web browser to configure it and check the event log. In the event a HTTP server rather than a secure HTTPS server is used, it is important to be aware of and manage security issues related to operation.

The railroad computing device includes an interface to a VHF radio that provides use of a standard handheld radio to send DTMF commands for processing 2 the device, and to receive response messages that are triggered by a running software application. This provides for the safe operation of equipment outside of an operators view, does so with multiple commands, while receiving audible messages to confirm the command was properly executed and when it is not properly executed, the reason the command failed. In one embodiment a software application can define up to 32 DPMP commands and playback 32 voice messages. A user can change DTMF codes using a web interface, or through the push button knob. To execute a change using the user interface, the user: (1) enters the configuration menu, (2) rotates the knob to locate the DTMF code that needs to be changed, (3) 'clicks'/selects the code to activate it, (4) types the new DTMF on a handheld radio, (5) checks the screen to verify that the code is correct (if is it not correct, the user may pause for two seconds and try again), and (6) if the new code is correct, clicks to activate the operation menu and move to the Desired option choice (see below), and (7) rotates the knob to locate the "Return" selection, and clicks/selects it to leave the configuration menu and resume normal operation. Desired option choices include: EDT (Edit) to resume editing the code, SAV (Save) to save the new code and leave, and EXT (Exit) to leave without saving.

A local user interface allows a user to set parameters directly in the railroad computing device's screen. However, for more specific settings, project/firmware upgrade or event log access, a user must use an embedded web interface via a laptop remotely using a connected network. Specific operation and setting are software and application specific.

Figure 7A:
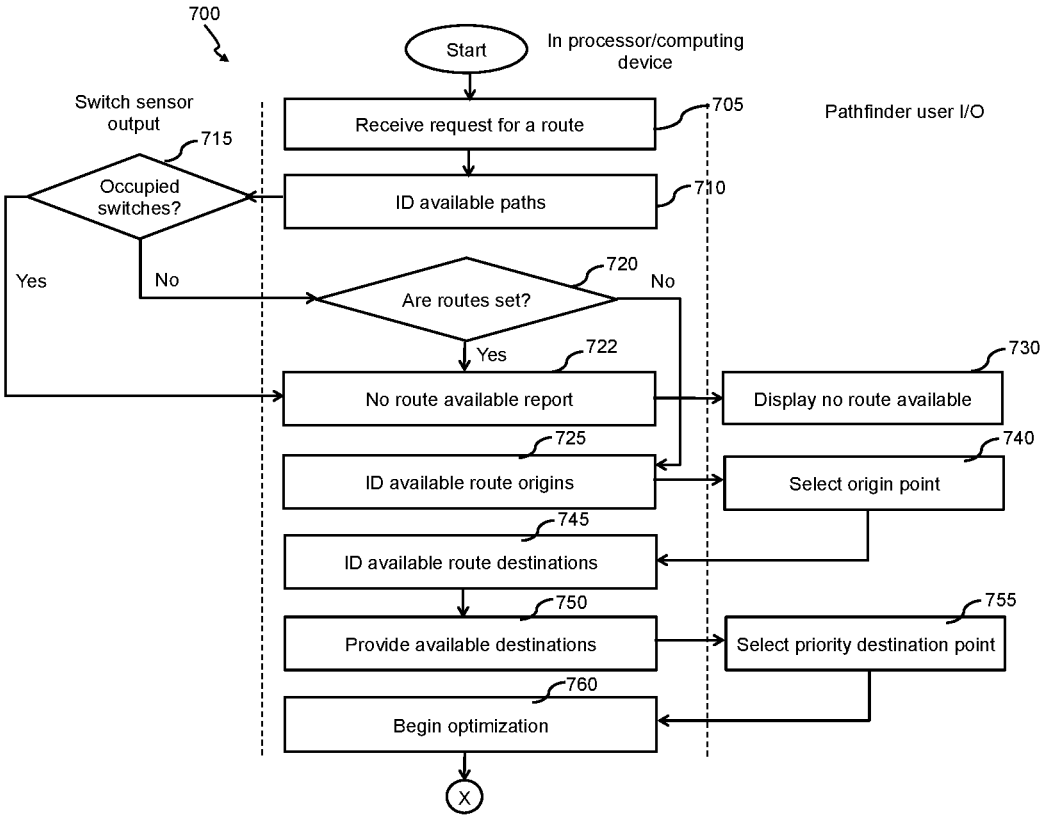
FIG. 7*a* is a flowchart depicting a method route optimization.
Figure 7B:
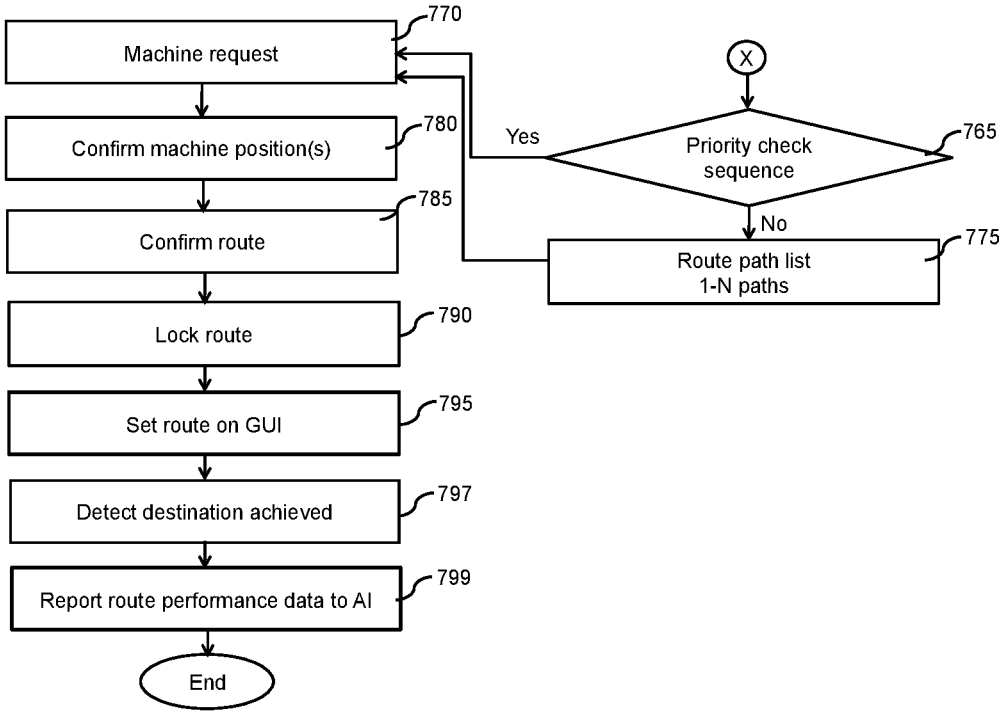
FIG. 7*b* continues the method for route optimization shown in FIG. 7*a;*

FIG. 7*a* is a flowchart of a railroad path optimization method 700 (the method 700) for finding an optimal route (aka "path") for a train, an engine, a railcar or other rail-travel enabled device (collectively, "train") in a railroad track system, including rail yards and rail lines. FIG. 7*b* continues the method for route optimization shown in FIG. 7*a*.

Figure 9:
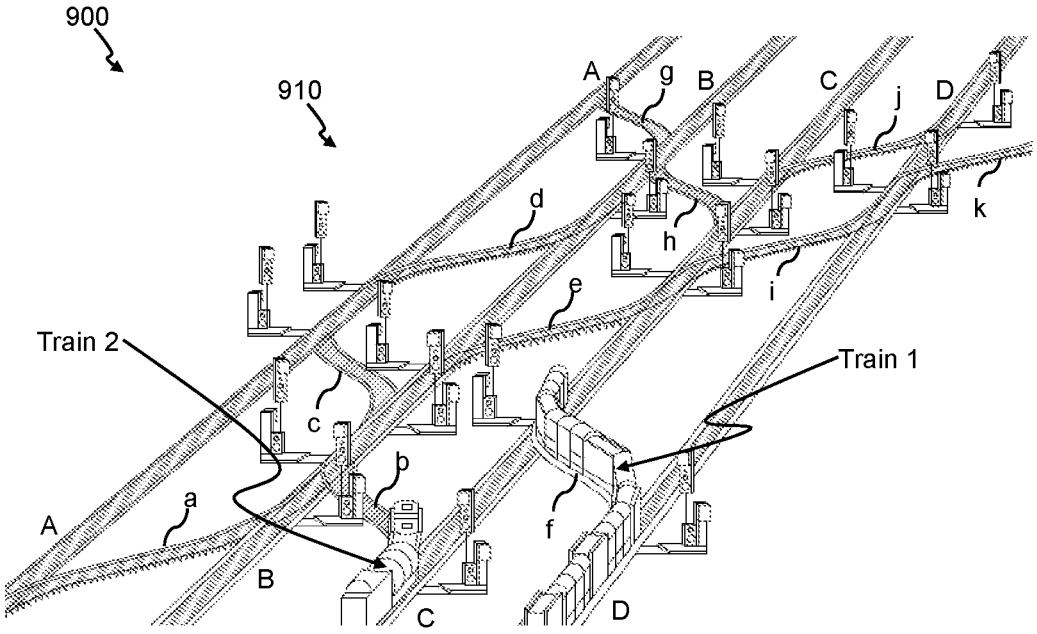
FIG. 9 is a screenshot illustrating a railyard in anticipation of a movement of a train from an origin to a destination according to the teachings of the invention.
Figure 10:
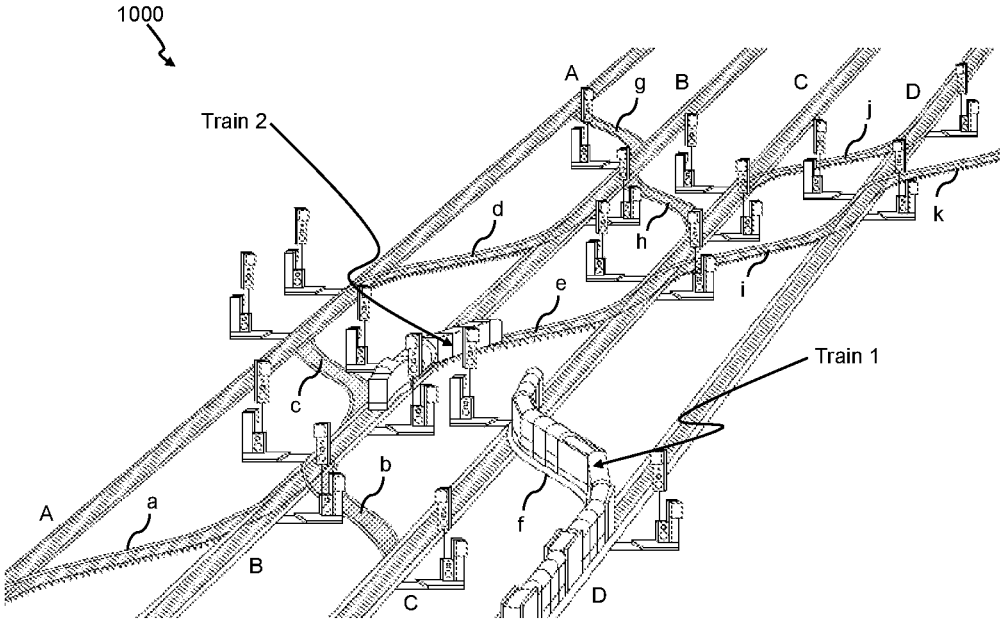
FIG. 10 is a screenshot showing a traveling train in the railyard and avoiding a stationary train blocking a preferred path.
Figure 11:
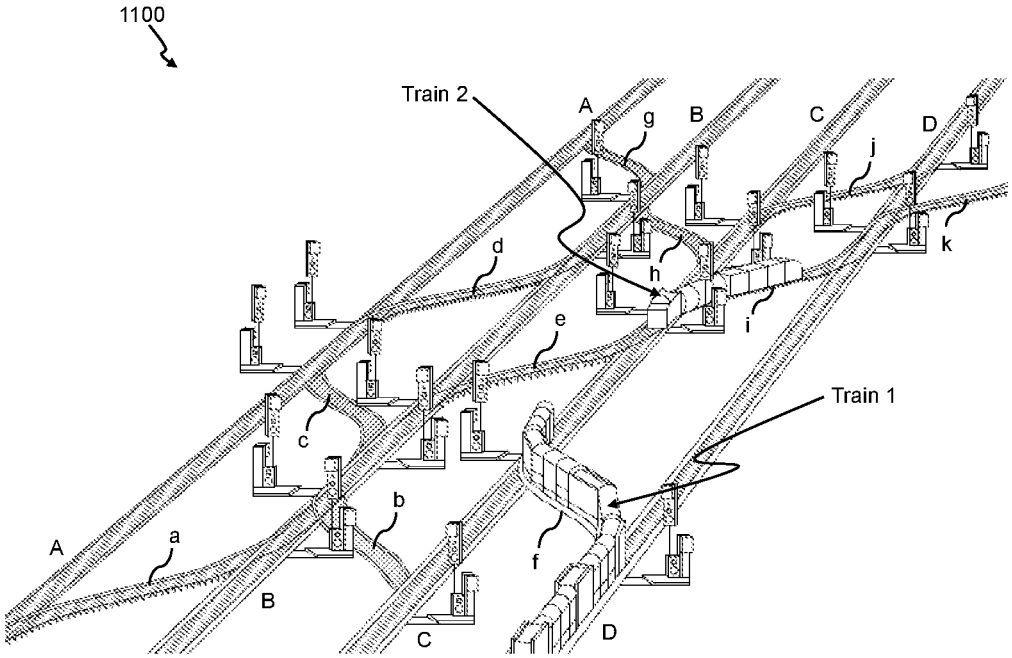
FIG. 11 is a screenshot showing the traveling train in the railyard having avoided the stationary train.
Figure 12:
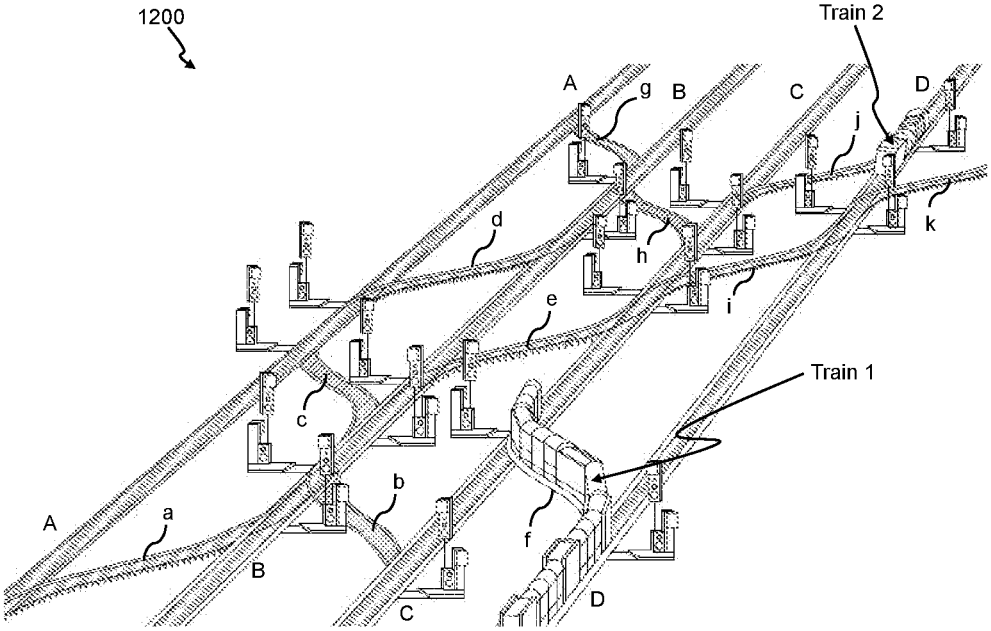
FIG. 12 is a screenshot showing the traveling train having moved to a destination in anticipation of exiting the railyard.

FIGS. 7*a* and 7*b* are read in conjunction with FIGS. 9-12. FIG. 9 is a screenshot illustrating a railyard in anticipation of a movement of a train from an origin to a destination according to the teachings of the invention. FIG. 10 is a screenshot showing a traveling train in the railyard and avoiding a stationary train blocking a preferred path. FIG. 11 is a screenshot showing the traveling train in the railyard having avoided the stationary train. Similarly, FIG. 12 is a screenshot showing the traveling train having moved to a destination in anticipation of exiting the railyard.

After being triggered either manually or automatically upon the occurrence of a predefined event such as a detected approach of a train ("start"), in a route request act 705, the method 700 receives a request to determine an optimal route between an origin and a destination from a plurality of potential routes in the railroad track system, such as a railyard 910 illustrated in FIG. 9. Then, in an available routes identification act 710 ("ID available paths"), the railroad computing device loads a set of possible routes between the origin and the desired destination. For example, in FIG. 9 a traveling train ("train 2") arrives at the railyard 910 on track C. This defines the railyard's entry point on track C as the origin, while the desired departure track from the railyard 910 is also known to be upon track C. The tracks A-D are interconnected with a variety of branches a-k, which along with the tracks A-D define a plurality of path choices between the origin and desired destination (indeed, additional unillustrated path choices may be available in the railyard), and these options are loaded into memory for consideration in the available routes identification act 710. In one embodiment, a logic set of all available routes between each origin and each destination are pre-stored in a computer memory locally, across a network, or in both locations.

Next, in an occupied tracks query 715, the method determines if one or more switch machine(s), such as switch machine 120, is occupied along each potential path. In alternative embodiments, other sensors and/or camera may detect occupied machines, track portions or branches, and these may also be reported as occupied. For example, in FIG. 10 Train 1 statically occupies tracks C and D and the switches that couple these two routes together via branch f.

If in the occupied tracks query 715 it is discovered that a switch machine is occupied along each potential path, then the method 700 moves to a report no routs available act 722 (shown as the "Y" path), where the method 700 then sends reporting information to display to a user in a display no routs available act 730 (this path terminates the method 700).

If in the occupied tracks query 715, however, one or more potential paths have only unoccupied switch machines in them (shown as the "N" path), then the method 700 continues to a routes set query 720. In the routes set query 720 the potential train paths are compared to ongoing or upcoming train paths. If ongoing or upcoming train paths indicate that all potential paths are or will soon be blocked by trains or other items having previously established route priority (shown by the "Y" path), then the method 700 proceeds to the report no routs available act 722.

If, on the other hand, in the routes set query 720 it is determined that at least one train path remains available, then the flowchart 700 stores the potential path(s) and continues to an identify available route origins act 725.

In the identify available route origins act 725 the method identifies potential route origins, and displays the route origin(s) to a user in a select origin point act 740. In the select origin point act 740 the method 700 receives at an input/output interface a user-selection of the desired route origin, which is then received and may further limit the choices of routes available (beyond those routes limited by occupied tracks/branches/switch machines). Stated another way, if a route is already set to be occupied, then the method 700 continuously checks until it finds "a route is not set condition".

The method then proceeds to an identify available route destinations act 745, where remaining available destinations are identified, and then in a select priority destination point act 755, are displayed to the user so that the user may choose a priority destination via a user-input. Upon receipt of the user-input in the select priority destination point act 755, the method next continues in a begin optimization act 760. Ideally, a plurality of routes flowing from the selected origin to the selected destination are unoccupied, whereby the method 700 proceeds to predict or select an optimal route from the available routes.

In the begin optimization act 760, the method 700 predicts an optimal route from the plurality of routes based on the at least one identified available route from the plurality of routes for the destination point. If there is only one optimal route available, the same may be considered and/or defined as 'the' optimal path. If more than one route is available, the railroad computing device utilizes/implements a priority check sequence query 765, where the railroad computing device ranks the routes to provide for selection of an optimal route for travel. When automated, a priority may be predefined based on estimated distance, time, or cost (or combination of these) associated with a particular route, for example. If a user-defined priority route is available, then the method 700 proceeds along a "Y" path to a machine request act 780 (discussed below).

During the priority check sequence 765, a sequence of checks are performed prior to setting track switch positions. In general, a user or customer may define preferences for determining routing, such as a user-defined priority route, a quickest route preference, or a shortest route preference, as well as define a generally preferred routes list/table.

For example, if the user-defined priority route is in the set of potential routes, then that route is chosen and the method proceeds to line the switches to accommodate that route in a machine request act 770. Similarly, if the user-defined priority route is occupied and unavailable, then the method 700 may then next check to see if a predicted quickest route is available in the set of potential routes, and if so the method 700 proceeds to the machine request act 770 to set the switch machines to accommodate the quickest route. Likewise, a shortest route preference may be tested and the switches accommodating it are likewise set in the machine request act 770.

If, however, none of the route preferences (user-defined, quickest, or shortest, for example) are available in the set of possible routes, then the method proceeds along a "N" path to a route path list act 775 to a predefined (default) list or table of i-N paths which are preferably listed in a ranked or priority order so that the method 700 may 'test' each route from most desirable to least desirable until an available potential route path is identified (and which defines the optimal available route).

After the method 700 sends the request message(s) to the switch machine(s) to be lined-up to implement the optimal route, in a confirm switch position act 780 the switch machine(s) generate switch machine position message(s). The switch machine position message(s) are received and processed by the method 700 in a confirm route act 785. The confirmation message indicates and verifies that each switch machine is lined-up for the optimal route.

Next, in a lock route act 790, the method 700 locks the optimal route into memory and locks the switch machine settings so that they may not be changed without the presence of overriding conditions. After locking the route in the lock route act 790, in a set route on GUI act 795 the method indicates (or otherwise displays) the optimal route on a device such as the view screen 252 for example, and allows setting/choosing the final optimal path for travel.

After the display/indication of the at least one predicted optimal route for travel on the screen 252 and setting/choosing the final optimal path for travel the method 700 estimates an arrival time. Then, in a detect destination achieved act 797, the method detects and records the train's actual arrival time. The actual arrival time of the train is preferably identified based on sensor data (real-time) received from a sensor by receiving sensor data.

After the switches are locked, a train may safely traverse the selected route. FIG. 11 is a screenshot showing the traveling train in the railyard having avoided the stationary train by traveling a route path C-b-e-C-i-D. Thus, FIG. 12 is a screenshot showing the traveling train having moved to a destination D in anticipation of exiting the railyard.

The method 700 may utilize artificial intelligence (AI)/machine learning in a report arrival time to AI act 799 (along with the other data collected as part of the process of determining potential paths and selecting optimal paths), which is used to train the AI for predicting route performances to help better select optimal route(s) based on arrival time, fuel consumption, time on a particular track, or time spent occupying one or more switches, for example. Further, in the perform AI act 799, the method 700 provides the AI continuous training data comprising the estimated arrival time of the rail and the actual arrival time of the rail at each intermediate destination point from a plurality of intermediate destination points (defined by specific switches, sensors, or other identifiable and measurable track locations) so to feed and train a neural network, which may be co-located in the railroad computing device, with training data which, over a period of time, may better enable predicting an optimal route, or estimated arrival time, for example.

The railroad computing device, locally or across a network, may implement a machine learning method called deep learning. The machine learning method enables the railroad computing device to automatically learn and improve from experience, over a period of time, without being explicitly programmed. The deep learning method uses a neural network capable of learning in an unsupervised manner from data that is unstructured or unlabeled. Deep learning is a method of machine learning that employs multiple layers of neural networks that enable the platform/device of the present invention to teach itself through inference and pattern recognition, rather than development of procedural code or explicitly coded software algorithms (however, machine learning is augmented and enhanced with software algorithms). The neural networks are modeled according to a neuronal structure of a mammal's cerebral cortex, where neurons are represented as nodes and synapses are represented as uniquely weighted paths or "tolled roads" between the nodes. The nodes are then organized into layers to comprise a network. Additionally, the neural networks are organized in a layered fashion that includes an input layer, intermediate or hidden layers, and an output layer.

The neural networks enhance their learning capability by varying the uniquely weighted paths based on received input. The successive layers within the neural network incorporate the learning capability by modifying their weighted coefficients based on their received input patterns. From this foundation, one can see that the training of the neural networks is very similar to how we teach children to recognize an object. The neural network is repetitively trained from a base data set, where results from the output layer (or, simply "output") are successively compared to the correct classification.

Alternatively, any machine learning paradigm instead of neural networks can be used in the training and learning process.

Figure 8:
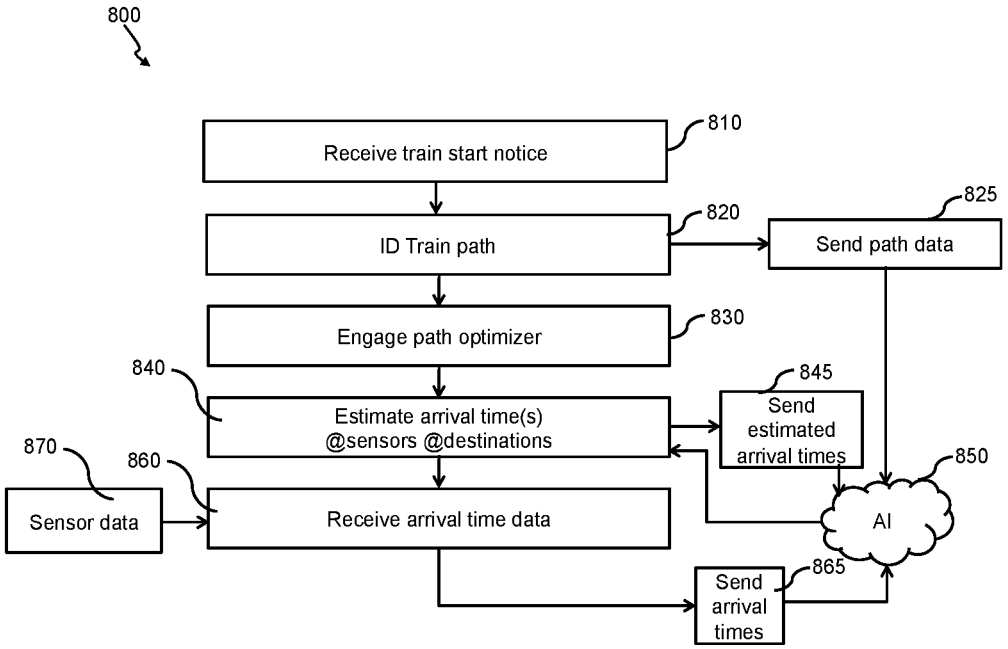
FIG. 8 is a flowchart depicting implementation of the aforesaid method.

FIG. 8 is an artificial intelligence (AI) training algorithm for predictive train arrival 800. The algorithm 800 begins with a receive training start notice act 810. In the receive tray start notice act 810 The algorithm 800 is notified that a train has started to traverse a path which loaded into memory in an identify train path act 820. The identify train path act 820 associates an origin and a destination with the identified train path and may also associate with it path data including estimated arrival times as discussed below. Path data may include data from the sensors, switches, and other known railroad items which exist across the identified train path.

Next, the algorithm 100 proceeds to an engage path optimizer act 830. In the engage path optimizer act 830, a path optimizer algorithm such as the path optimization method 700, is queried and an optimized path is predicted, identified, and evaluated for predicted performance parameters such as arrival times. Then, an estimate arrival times act 840 estimates a specific or window for an arrival time for the train traveling the identified train path including at each (or selected) sensors, switches, and/or other railroad items, as well as at the destination of the identified train path. In a send estimated arrival times output 845, these estimated arrival times are transmitted to an artificial intelligence (AI)/machine learning system 850.

The AI/machine learning system 850 may be located locally in a railroad computing device, or across a network, such as in a cloud computing system stack such as the Azure stack, or Mongo DB, for example. Following the estimated arrival times act 840, the algorithm 800 proceeds to a receive arrival time data act 860 in which real-world arrival times are gathered and stored, and then advanced for additional use. To achieve this, a sensor data act 870 generates and provides arrival time data to the receive arrival time data act 860 (which preferably includes arrival times at switches, sensors, and the ultimate destination). The actual arrival times at each sensor, switch, or other railroad item is sent in a send arrival times act 865 to the AI/machine learning system 850.

The artificial intelligence is thus trained to utilize the above performance data to generate better estimated arrival times along the identified train path. The real world/actual estimated arrival times generated by the AI/machine learning system 850 then becomes input data that can then be used to estimate more accurate arrival times in the estimate arrival times at 840. The algorithm 800 ends after the identified train reaches the identified trade path destination and data associated with its path is processed in anticipation of a next receipt of a train start notice.

Although the invention has been described and illustrated with specific illustrative embodiments, it is not intended that the invention be limited to those illustrative embodiments. Those skilled in the art will recognize that variations and modifications can be made without departing from the spirit of the invention. Therefore, it is intended to include within the invention, all such variations and departures that fall within the scope of the appended claims and equivalents thereof.

What is claimed is:

1. A method for finding an optimal route for a rail in a railroad track system, the method comprising:

receiving a request to find at least one optimal route from a plurality of routes in the railroad track system;

identifying at least one route from the plurality of routes to travel;

determining whether at least one switch machine from a plurality of switch machines is occupied in the at least one route;

detecting at least one unavailable route from the plurality of routes upon determining that the at least one switch machine from the plurality of switch machines is occupied;

identifying at least one desired route and at least one available route associated with an origin point and at least one desired route and at least one available route associated with a destination point;

identifying at least one available route from the plurality of routes for the destination point based on the at least one desired route and the at least one available route associated with the origin point and the at least one desired route and the at least one available route associated with the destination point;

predicting the at least one optimal route from the plurality of routes based on the at least one identified available route from the plurality of routes for the destination point; and ranking the at least one predicted optimal route from the plurality of routes to enable selection of a final optimal route for travel.

2. The method of claim 1 wherein ranking the at least one predicted optimal route from the plurality of routes to enable selection of the final optimal route for travel comprises:

determining that the at least one predicted optimal route from the plurality of routes is flagged as a priority;

sending a request message to the at least one switch machine from the plurality of switch machines to be lined-up for the at least one predicted optimal route;

receiving a confirmation message from the at least one switch machine from the plurality of switch machines based on the request message, wherein the confirmation message indicates that the at least one switch machine from the plurality of switch machines is lined-up for the at least one predicted optimal route;

confirming the at least one predicted optimal route from the plurality of routes for travel;

locking the at least one predicted optimal route for travel; and displaying the at least one predicted optimal route for travel on a screen.

3. The method of claim 1 wherein ranking the at least one predicted optimal route from the plurality of routes to enable selection of the final optimal route for travel comprises:

determining that the at least one predicted optimal route from the plurality of routes is not flagged as a priority;

determining that the at least one predicted optimal route from the plurality of routes is flagged as a quickest route preference;

sending a request message to the at least one switch machine from the plurality of switch machines to be lined-up for the at least one predicted optimal route;

receiving a confirmation message from the at least one switch machine from the plurality of switch machines based on the request message, wherein the confirmation message indicates that the at least one switch machine from the plurality of switch machines is lined-up for the at least one predicted optimal route;

confirming the at least one predicted optimal route from the plurality of routes for travel;

locking the at least one predicted optimal route for travel; and displaying the at least one predicted optimal route for travel on a screen.

4. The method of claim 1 wherein ranking the at least one predicted optimal route from the plurality of routes to enable selection of the final optimal route for travel comprises:

determining that the at least one predicted optimal route from the plurality of routes is not flagged as a priority;

determining that the at least one predicted optimal route from the plurality of routes is not flagged as a quickest route preference;

determining that the at least one predicted optimal route from the plurality of routes is flagged as a shortest route preference;

sending a request message to the at least one switch machine from the plurality of switch machines to be lined-up for the at least one predicted optimal route;

receiving a confirmation message from the at least one switch machine from the plurality of switch machines based on the request message, wherein the confirmation message indicates that the at least one switch machine from the plurality of switch machines is lined-up for the at least one predicted optimal route;

confirming the at least one predicted optimal route from the plurality of routes for travel;

locking the at least one predicted optimal route for travel; and displaying the at least one predicted optimal route for travel on a screen.

5. The method of claim 1 wherein ranking the at least one predicted optimal route from the plurality of routes to enable selection of the final optimal route for travel comprises:

determining that the at least one predicted optimal route from the plurality of routes is not flagged as a priority;

determining that the at least one predicted optimal route from the plurality of routes is not flagged as a quickest route preference;

determining that the at least one predicted optimal route from the plurality of routes is not flagged as a shortest route preference;

detecting at least one route list for the at least one predicted optimal route from the plurality of routes;

sending a request message to the at least one switch machine from the plurality of switch machines to be lined-up for the at least one predicted optimal route;

receiving a confirmation message from the at least one switch machine from the plurality of switch machines based on the request message, wherein the confirmation message indicates that the at least one switch machine from the plurality of switch machines is lined-up for the at least one predicted optimal route;

confirming the at least one predicted optimal route from the plurality of routes for travel;

locking the at least one predicted optimal route for travel; and displaying the at least one predicted optimal route for travel on a screen.

6. The method of claim 1 wherein the method comprises:

obtaining continuous training data comprising an estimated arrival time of the rail and an actual arrival time of the rail at each destination point from a plurality of destination points; and feeding and training a neural network present in the railroad computing device with the training data over a period of time for predicting at least one of at least one possible optimal route, possible estimated arrival time of the rail and possible actual arrival time of the rail.

7. A railroad computing device for finding an optimal route for a rail in a railroad track system, wherein the railroad computing device is configured to:

receive a request to find at least one optimal route from a plurality of routes in the railroad track system;

identify at least one route from the plurality of routes to travel;

determine whether at least one switch machine from a plurality of switch machines is occupied in the at least one route;

detect at least one unavailable route from the plurality of routes upon determining that the at least one switch machine from the plurality of switch machines is occupied;

identify at least one desired route and at least one available route associated with an origin point and at least one desired route and at least one available route associated with a destination point;

identify at least one available route from the plurality of routes for the destination point based on the at least one desired route and the at least one available route associated with the origin point and the at least one desired route and the at least one available route associated with the destination point;

predict the at least one optimal route from the plurality of routes based on the at least one identified available route from the plurality of routes for the destination point; and rank the at least one predicted optimal route from the plurality of routes to enable selection of a final optimal route for travel.

8. The railroad computing device of claim 7 wherein rank the at least one predicted optimal route from the plurality of routes to enable selection of the final optimal route for travel comprises:

determine that the at least one predicted optimal route from the plurality of routes is flagged as a priority;

send a request message to the at least one switch machine from the plurality of switch machines to be lined-up for the at least one predicted optimal route;

receive a confirmation message from the at least one switch machine from the plurality of switch machines based on the request message, wherein the confirmation message indicates that the at least one switch machine from the plurality of switch machines is lined-up for the at least one predicted optimal route;

confirm the at least one predicted optimal route from the plurality of routes for travel;

lock the at least one predicted optimal route for travel; and display the at least one predicted optimal route for travel on a screen.

* * * * *